US008267284B2

(12) United States Patent
Ray

(10) Patent No.: US 8,267,284 B2
(45) Date of Patent: Sep. 18, 2012

(54) TWO-STROKE FOAM PUMP

(75) Inventor: Eugene W. Ray, Barberton, OH (US)

(73) Assignee: GOJO Industries, Inc., Akron, OH (US)

( * ) Notice: Subject to any disclaimer, the term of this patent is extended or adjusted under 35 U.S.C. 154(b) by 636 days.

(21) Appl. No.: 12/488,128

(22) Filed: Jun. 19, 2009

(65) Prior Publication Data

US 2009/0314806 A1 Dec. 24, 2009

(51) Int. Cl.
*B67D 5/56* (2006.01)

(52) U.S. Cl. ..... 222/190; 222/145.5

(58) Field of Classification Search ..... 222/145.5, 222/145.1, 386, 136, 321.1, 321.6–321.9, 222/382, 383.1, 383.3, 464.1, 190, 145.4
See application file for complete search history.

(56) References Cited

U.S. PATENT DOCUMENTS

| | | | | |
|---|---|---|---|---|
| 4,477,000 | A | 10/1984 | Arabian | |
| 5,445,288 | A * | 8/1995 | Banks | 222/95 |
| 6,082,586 | A * | 7/2000 | Banks | 222/95 |
| 6,601,736 | B2 | 8/2003 | Ophardt | |
| 7,861,895 | B2 * | 1/2011 | Ray | 222/189.11 |
| 8,047,403 | B2 * | 11/2011 | Quinlan et al. | 222/190 |
| 8,079,497 | B2 * | 12/2011 | Brouwer | 222/153.13 |
| 2005/0205600 | A1 * | 9/2005 | Ophardt et al. | 222/1 |
| 2007/0023454 | A1 * | 2/2007 | Ophardt | 222/190 |
| 2007/0040048 | A1 | 2/2007 | Poizot | |

FOREIGN PATENT DOCUMENTS

| | | |
|---|---|---|
| DE | 102005012121 Al | 10/2005 |
| WO | 01/39893 | 6/2001 |

OTHER PUBLICATIONS

European Patent Office Search Report dated Mar. 25, 2011 in European Patent Application No. 09163115.0 of GOJO Industries, Inc.

* cited by examiner

*Primary Examiner* — Kevin P Shaver
*Assistant Examiner* — Donnell Long
(74) *Attorney, Agent, or Firm* — Calfee, Halter & Griswold LLP

(57) ABSTRACT

A two-stroke foam pump includes a piston housing and a piston assembly retained therein, the interaction of the piston housing and piston assembly defining a compressible mixing chamber. Movement of the piston assembly within the piston housing in one direction increases the volume of the compressible mixing chamber to draw liquid and air therein, and movement of the piston assembly within the piston housing in a direct opposite thereto decreases the volume of the compressible mixing chamber to expel liquid and air from the compressible mixing chamber as a foam product.

20 Claims, 4 Drawing Sheets

TWO-STROKE FOAM PUMP

FIELD OF THE INVENTION

The invention herein resides in the art of foam pumps, wherein a foamable liquid and air are combined to dispense a foam product. More particularly, the invention relates to a two-stroke foam pump wherein air and foamable liquid are drawn into a compressible mixing chamber by a first stroke, and expelled from the pump through a foam screen by the second stroke.

BACKGROUND OF THE INVENTION

For many years, it has been known to dispense liquids, such as soaps, sanitizers, cleansers, disinfectants, and the like from a dispenser housing maintaining a refill unit that holds the liquid and provides the pump mechanisms for dispensing the liquid. The pump mechanism employed with such dispensers has typically been a liquid pump, simply emitting a predetermined quantity of the liquid upon movement of an actuator. Recently, for purposes of effectiveness and economy, it has become desirable to dispense the liquids in the form of foam generated by the interjection of air into the liquid. Accordingly, the standard liquid pump has given way to a foam generating pump, which necessarily requires means for combining the air and liquid in such a manner as to generate the desired foam.

Typically foam dispensers generate foam by pumping a foamable liquid stream and an air stream to a mixing area and forcing the mixture through a screen to better disperse the air as bubbles within the foamable liquid and create a more uniform foam product. The more minute and numerous the air bubbles the thicker and softer the foam, although too much or too little air can cause the foam to be of poor quality. The key to a desirable foam product is violent mixing of the foamable liquid and air to disperse the air bubbles within the liquid. Many existing foam pump designs, in an effort to achieve desirable foam, which require a high number of parts and are susceptible to leakage while not in use. Thus, there is a need for a simple foam pump having few parts and preventing leakage when not in use.

SUMMARY OF THE INVENTION

This invention provides a two-stroke foam pump. The two-stroke foam pump includes a piston housing including a base wall and at least one sidewall extending from said base wall. It also includes a piston assembly including a piston having a base end. The piston is selectively movable in the piston housing, from a rest position wherein the base end lies proximate the base wall of the piston housing, to a charged position wherein the base end lies farther away from the base wall. Movement of the base end away from the base wall serves to define a compressible mixing chamber that expands in volume as the base end is moved away from the base wall, and decreases in volume as the base end is moved toward the base wall. An outlet passage extends through the piston, from the base end to an outlet, and the outlet passage fluidly communicates with the compressible mixing chamber. A liquid inlet in the piston housing communicates with the compressible mixing chamber. A liquid inlet valve regulates the flow of fluid into the compressible mixing chamber through the liquid inlet. An air inlet also communicates with the compressible mixing chamber such that, movement of the base end away from the base wall increases the volume of the compressible mixing chamber thus drawing air into the compressible mixing chamber through the air inlet and drawing liquid into the compressible liquid chamber through the liquid inlet, thereby creating a premix of liquid and air in the compressible mixing chamber, and wherein, thereafter, movement of the base end toward the base wall forces at least a portion of the premix of liquid and air through the outlet passage of the piston.

DETAILED DESCRIPTION OF ILLUSTRATIVE EMBODIMENTS

Figure 1:
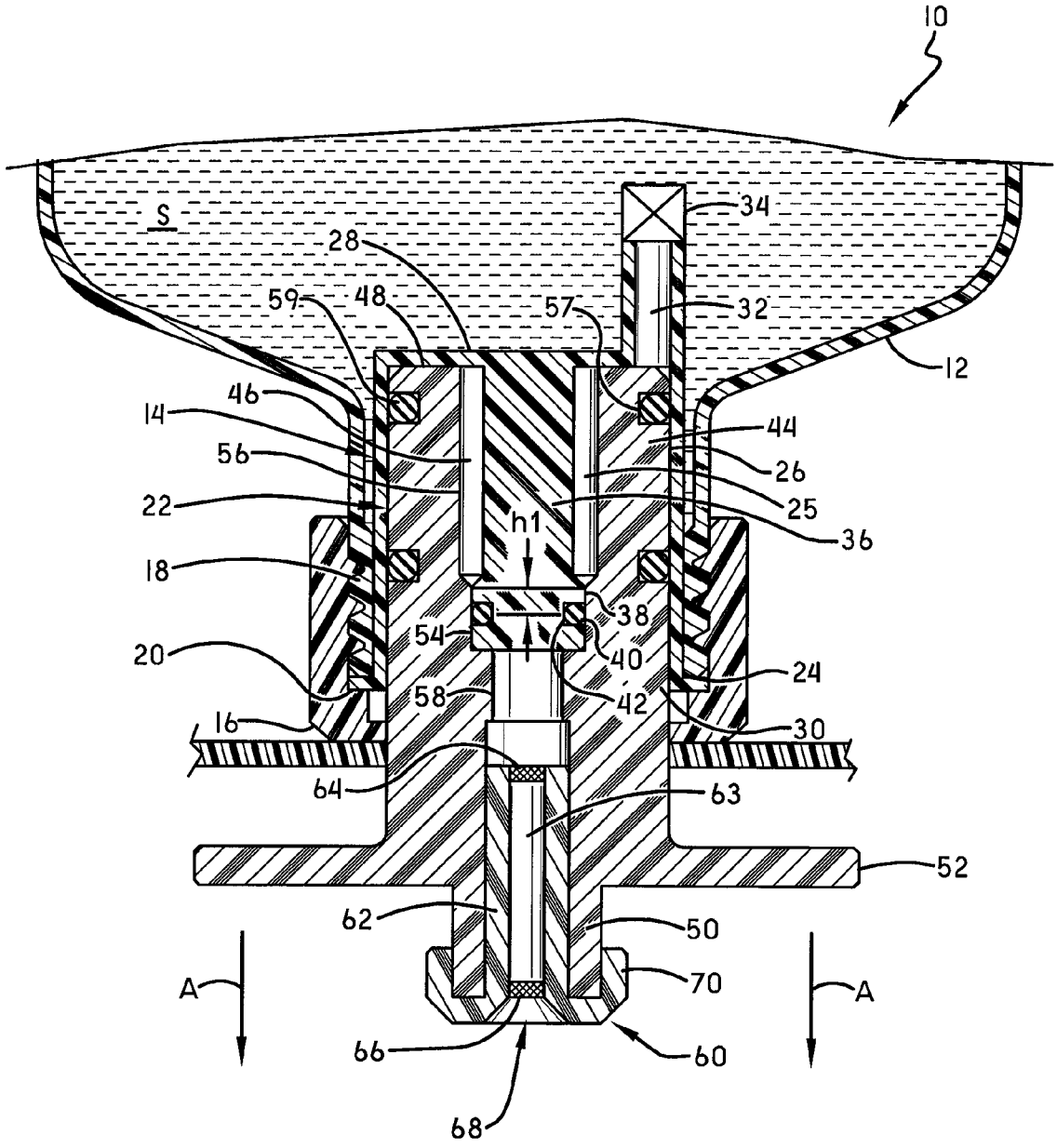
FIG. 1 is a cross section view of a first embodiment of a two-stage foam pump according to the concepts of this invention, shown in a rest state.
Figure 2:
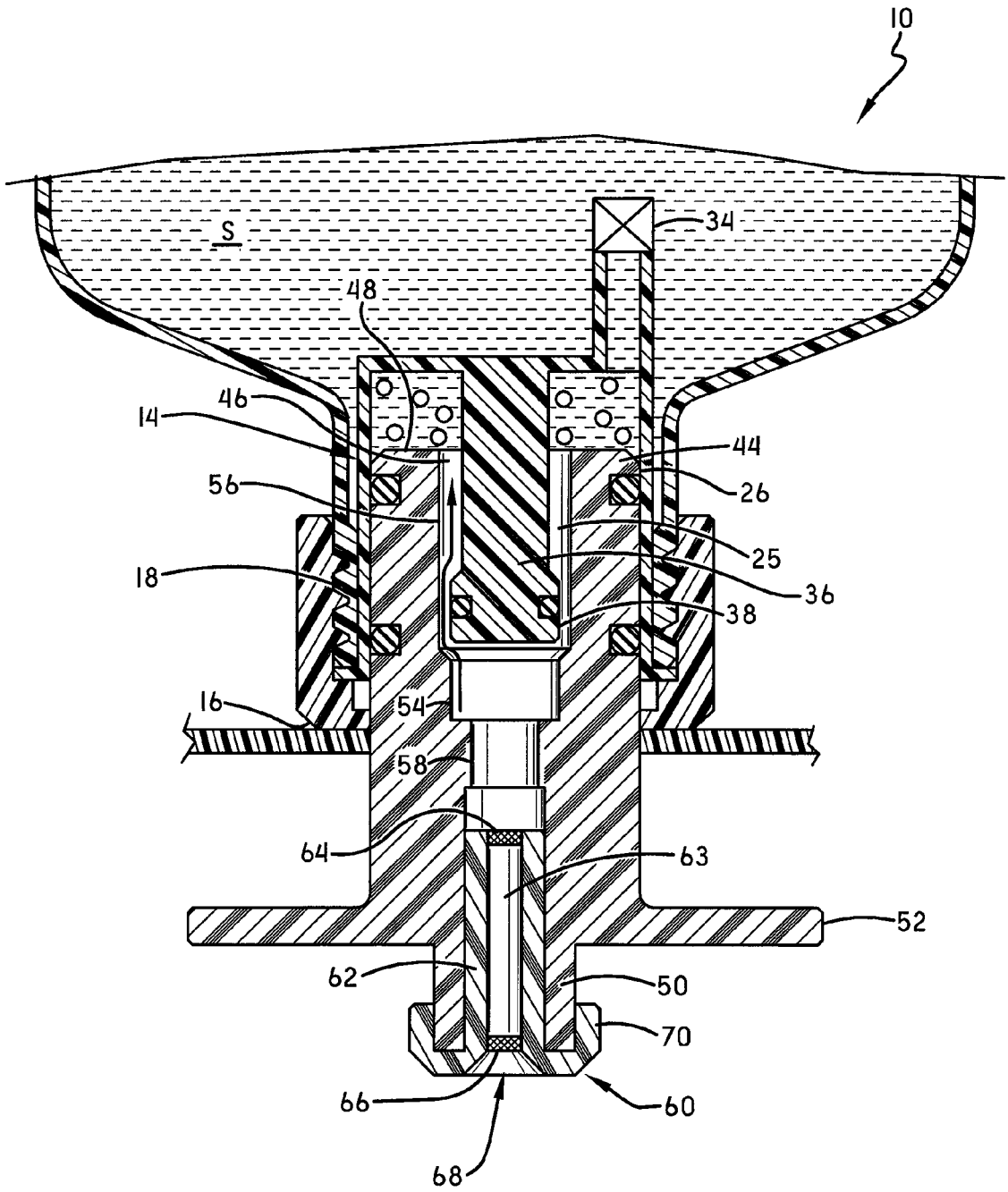
FIG. 2 is a cross section view of the first embodiment, shown in a charged state.

A refill unit including a first embodiment of a two-stroke foam pump according to the concepts of the present invention is shown in FIGS. 1 and 2 and is indicated generally by the numeral 10. Refill unit 10 includes a container 12 filled with a foamable liquid S and adapted to fit within an existing dispenser housing (not shown) as generally known and practiced in the art. A foam pump 14 is secured to container 12 by an over-cap 16. Container 12 is filled with a foamable liquid S, and has a threaded neck 18 in which foam pump 14 is received, with a flange 20 on a housing 22 of foam pump 14 engaging an end 24 of neck 18. Over-cap 16 is internally threaded, and is adapted to mate with and screw onto neck 18 to secure foam pump 14 within neck 18. By securing flange 20 between end 24 of neck 18 and over-cap 16, foam pump 14 is secured in place. As is conventional in the art of foam pumps, foam pump 14 mixes foamable liquid S and air in a mixing chamber to generate a foam product. According to the concepts of the present invention, foam pump 14 utilizes a two-stroke action of a piston to mix and generate the foam product.

Foam pump 14 includes housing 22 with a compressible mixing chamber 25 therein, housing 22 having a sidewall 26, a base wall 28, and an open end 30. Flange 20 extends outwardly from sidewall 26, adjacent open end 30 to engage end 24 of neck 18, as discussed above. Thus, housing 22 fits within neck 18 and extends into container 12, with open end 30 positioned proximate end 24 of neck 18. Base wall 28 includes an aperture 32 therein, and a one-way valve 34 positioned within aperture 32 to control the flow of foamable liquid S from container 12 into mixing chamber 25. Housing 22 also includes a post 36 extending from base wall 28 towards open end 30. Post 36 is positioned substantially in the center of mixing chamber 25 and may include an end portion 38 having a slightly larger diameter. End portion 38 may include an annular sealing member 40 located in an annular recession 42 in the end portion 38. Annular sealing member 40 is shown here as an O-ring, but other seals may be employed.

A piston 44 having a bore 46 therein is slidably received within mixing chamber 25 surrounding post 36. When in a rest state, piston 44 has a base end 48 positioned adjacent to base wall 28, and a dispensing end 50 located outside of housing 22 and over-cap 16. Piston 44 also includes an actuation flange 52 that interacts with an actuating mechanism to cause movement of piston 44.

Bore 46 includes three sections having different diameters. A first section 54 of bore 46, surrounds and interacts with seal 40 on end portion 38 of post 36 when piston 44 is in a rest state. More particularly, first section 54 has a diameter approximately equal to but slightly greater than the diameter of end portion 38, and engages seal 40 sufficiently to create a suitable air and liquid tight seal. A second section 56 of bore 46 extends from first section 54 to base end 48 and has a diameter larger than that of first section 54. Because of the larger diameter of second section 56 there exists a space between an interior wall of bore 46 and the exterior wall of post 36. The length of first section 54 and second section 56 may vary depending upon the desired foam characteristics, as will be discussed in more detail below. A third section 58 of bore 46 extends from first section 54 at the distal end of post 36 towards dispensing end 50 of piston 44 and has a diameter less than that of end portion 38. The diameter of third section 58 of bore 46 may be further reduced, either gradually or in an additional step, nearer to dispensing end 50 in order to control the amount of air that flows into mixing chamber 25 when pump 14 is actuated as will be appreciated from disclosures herein below.

Piston 44 also includes one or more annular recesses 57 around its outer surface, with an annular sealing member 59 positioned in each of these recesses, between piston 44 and sidewall 26. Annular sealing member 59 is shown as O rings, though not limited thereto or thereby. A mixing cartridge 60 is positioned within bore 46, proximate dispensing end 50 of piston 44. Mixing cartridge 60 includes a tubular body 62 with a passage 63 therethrough. Passage 63 is bounded by an inlet mesh 64 and an outlet mesh 66. The outlet mesh 66 is positioned proximate the pump outlet 68. It should be appreciated that the mixing cartridge 60 provides opposed meshes that function to create a high quality foam product, but a single mesh could be used instead. Mixing cartridge 60 may also include a U-shaped retaining portion 70 that engages a portion of piston 44 to help to secure mixing cartridge 60 within bore 46.

From a rest state, as seen in FIG. 1, foam pump 14 is manipulated to the charged state of FIG. 2 by moving piston 44 in the direction of arrow A, thereby drawing air and foamable liquid S into mixing chamber 25. The foam pump 14 is then returned to the rest state to force the air and foamable liquid mixture out through pump outlet 68. The biasing mechanism and actuating mechanism may be integral with the existing housing in which the refill unit 10 is to be installed. Various configurations may be employed to accomplish the desired biasing and actuation of the foam pump 14. For example, a spring bias could be used to bias the piston 44 in a rest state, and a push-bar element associated with the housing could be actuated to pull actuating flange 52 until a limit is reached. This would charge mixing chamber 25, and after charging, the push-bar would release actuating flange 52 so that the piston 44 would return to its rest state by the spring bias. Alternatively, a powered mechanical linkage, or "hands free" actuator may be used as is well known to persons having ordinary skill in the art.

To dispense product from foam pump 14, piston 44 is moved away from base wall 28 of housing 22. Initially, movement of piston 44 will cause mixing chamber 25 to grow in volume, thus creating a vacuum therein so long as first section 54 of bore 46 remains in contact with end portion 38 of post 36 through seal 40. The vacuum created by movement of piston 44 will cause foamable liquid S to be drawn into mixing chamber 25 through one way valve 34. Once piston 44 moves far enough from base wall 28 to move seal 40 out of contact with first section 54, the distance of movement required indicated by $h_1$ in FIG. 1, the seal will be broken. When the seal is broken, the vacuum within mixing chamber 25 will cease to exist, and instead further movement of piston 44 will cause air to flow in through pump outlet 68, through passage 63, and into mixing chamber 25. Thus, the increased diameter of second section 56 releases the vacuum seal to permit the introduction of air, but only after a measured amount of foamable liquid S has been introduced into mixing chamber 25. The amount of foamable liquid S drawn into mixing chamber 25 can be altered by either changing the size or type of one-way valve 34 used, by increasing or decreasing the length ($h_1$) that piston 44 must travel before the vacuum is released. By increasing the axial length of first section 54 of bore 46, the amount of foamable liquid S drawn into mixing chamber 25 will be increased, and by decreasing the axial length of first section 54 the amount of foamable liquid S drawn into mixing chamber 25 will decrease. Even without changing the axial length of the first section 54, the length (h1) may be altered by adjusting the rest state position of piston 44 to be further away from base plate 28 by an adjustment means located in the dispenser.

After piston 44 has been fully actuated and foam pump 14 is in a charged state of FIG. 2, piston 44 is returned to the rest state of FIG. 1, by an actuating mechanism or under the influence of a biasing mechanism, thereby forcing the foamable liquid and air mixture out through bore 46 and mixing cartridge 60 as mixing chamber 25 collapses. The decreasing volume within mixing chamber 25 and, consequently, the increasing pressure, will cause the foamable liquid and air mixture to flow out through mixing cartridge 60. Notably, in this embodiment, the passage 63 serves as an air inlet passage during expansion of the volume of the compressible mixing chamber 25, and serves as the outlet passage for the mixed air and liquid during contraction of the volume of the compressible mixing chamber 25.

Figure 3:
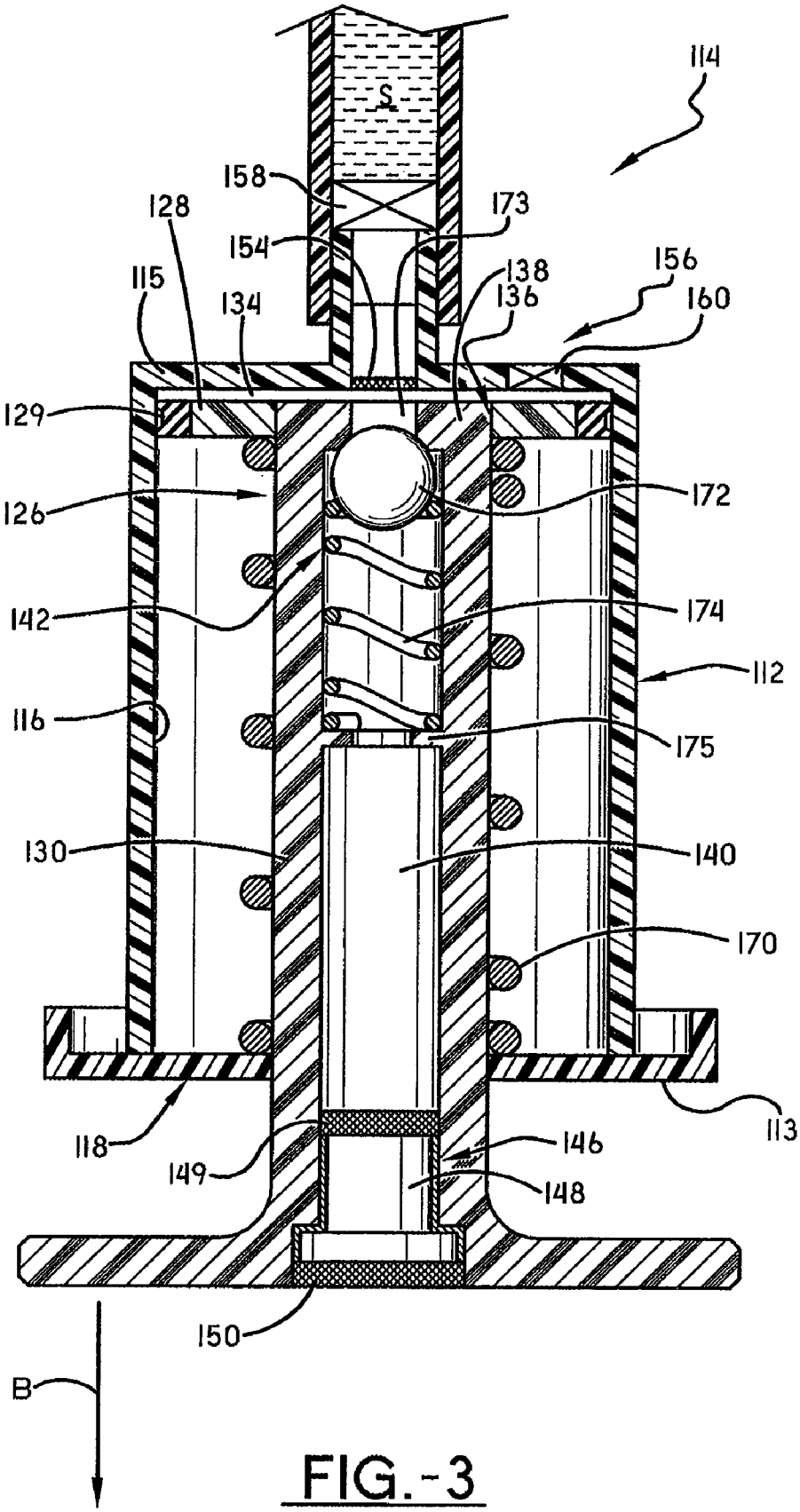
FIG. 3 is a cross section view of a second embodiment of the two-stage foam pump according to the concepts of the present invention, shown in a rest state.
Figure 4:
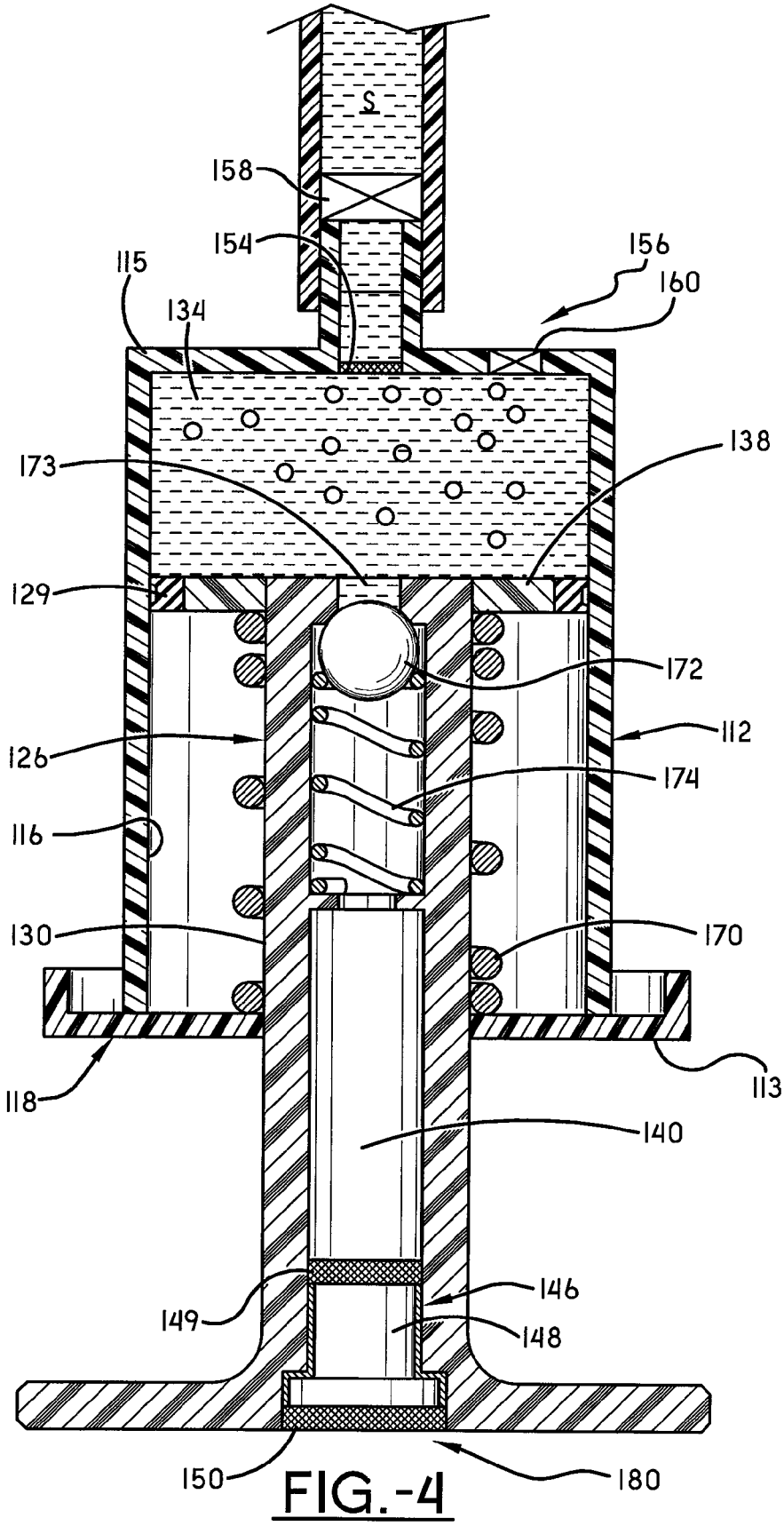
FIG. 4 is a cross section view of the second embodiment, shown in a charged state.

FIGS. 3 and 4 depict a second embodiment of the present invention. An alternative two-stroke foam pump 114 is shown, which may be incorporated into a refill unit by being positioned within a container in a similar manner as foam pump 14 was received in cartridge 12 in the first embodiment discussed above, with a flange 113 engaging an end 24 of neck 18 as secured thereto by an over-cap.

Foam pump 114 includes a piston housing 112 with a base wall 115 and at least one sidewall 116 extending from base end 115 to a cover plate 118. Foam pump 114 further includes a piston assembly 126 including a piston 130 having a base end 128. Base end 128 is slidably positioned in housing 112 and contacts sidewall 116 with a wiper seal 129. The piston 130 is movable from the rest position of FIG. 3 to the charged position of FIG. 4, and, much like the pump of FIGS. 1 and 2 is moved between these positions to dispense product.

An inner volume defined by the space between base end 128, side wall 116, and base wall 115 constitutes a compressible mixing chamber 134, which, in FIG. 3, is substantially collapsed to a minimal volume, lying up against base wall 115. Compressible mixing chamber 134 expands in volume as piston 130 is moved toward the charged state of FIG. 4, moving base end 128 from the rest position of FIG. 3, where wiper seal 129 lies proximate base wall 115, to the charged position of FIG. 4, where wiper seal 129 lies proximate cover plate 118. Conversely, compressible mixing chamber 134 decreases in volume as base end 128 is moved from the charged position to the rest position. Base end 128 may include an aperture 136 therethrough in which piston 130 is secured or the base end 128 and piston 130 might be of one piece. A seal is created between base end 128 and piston 130 such that fluid and air within compressible mixing chamber 134 does not escape at increased pressures around piston 130. The seal may be provided by any known mechanism or method known to persons skilled in the art. As shown in the figures, an extension 138 of piston 130 is press fit and/or glued into aperture 136 to secure piston 130 therein.

Piston 130 includes an outlet passage 140 that is in fluid communication with compressible mixing chamber 134. A one-way outlet valve 142 is provided within outlet passage 140 which allows fluid flow from compressible mixing chamber 134 through outlet valve 142 and into outlet passage 140 but prevents fluid flow from outlet passage 140 through outlet valve 142 and into compressible chamber 134. Although shown here as a well-known ball valve having a ball 172 biased to close off inlet 173 by a spring 174 and spring mount 175, the outlet valve may take other forms. Outlet valve 142 may be one of many conventional one-way valves, such as duckbill valves, flapper valves, or elastomer cross-slit valves (also known as a Zeller or LMS style valves). Outlet passage 140 further includes at least one mesh screen therein, through which the liquid and air mixture is forced prior to exiting foam pump 114. The at least one mesh screen may be in the form of a mixing cartridge 146 which consists of a hollow tube 148 bounded on both ends by mesh screens 149 and 150.

Housing 112 further includes a liquid inlet 154 and an air inlet 156, each of which allows fluid flow into compressible mixing chamber 134 as it expands as base end 128 moves away from base wall 115. Here, they are shown in base wall 115, though it will be appreciated after disclosure of the functioning of the foam pump 114 that they might otherwise be positioned to communicate with the compressible mixing chamber 134. A liquid inlet valve 158 is positioned between a source of foamable liquid in a liquid container (not shown) and liquid inlet 154 to regulate fluid flow into mixing chamber 134. Liquid inlet valve 158 is a one-way valve that permits flow through the valve and into compressible mixing chamber 134 and prevents fluid flow from compressible mixing chamber 134 out through liquid inlet valve 158. Similarly, a one-way air inlet valve 160 is positioned at air inlet 156 to permit air flow into, but not out of, compressible mixing chamber 134. Air inlet 156 will typically communicate with the ambient atmosphere, though it could communicate with a separate designated air source. The sizes of liquid inlet 154 and air inlet 156 and/or their resistances to flow may be varied to increase or decrease the amount of liquid or air provided upon actuation of foam pump 114.

A biasing mechanism 170, shown here as a spring, is positioned around piston 130 between base end 128 and cover plate 118 of housing 112 to bias piston assembly 126 in a rest position and to return piston assembly 126 to the rest position after actuation. It should be appreciated, however, that in the absence of a biasing mechanism, foam pump 114 may still operate by manual movement of piston assembly 126 in both directions to charge the pump 114 and to cause discharge of the foamable liquid and air mixture. This is also true for the pump 14 of FIGS. 1 and 2, and this fact should be readily appreciable.

Due to the influence of biasing mechanism 170, foam pump 114 remains in a rest position, as shown in FIG. 2, with base end 128 proximate base end 115. To actuate foam pump 114, piston assembly 126 is urged to overcome the biasing force of biasing mechanism 170, moving base end 128 in the direction of arrow B, away from base end 115 towards cover plate 118. The expanding volume of compressible mixing chamber 134 creates a vacuum, thereby pulling foamable liquid from its source, through inlet valve 158, and pulling air from its source (e.g. atmosphere) through air inlet valve 160, thus charging the chamber 134 with both foamable liquid and air. After being charged with liquid and air, piston assembly 126 is returned to its rest position. Because liquid inlet valve 168 and air inlet valve 160 do not allow fluid flow out of compressible mixing chamber 134, the liquid and air mixture is forced out through outlet valve 142 in outlet passage 140 and through mixing cartridge 146 to create high quality foam dispensed at outlet 180. Upon returning to its rest state, piston assembly 126 is ready for subsequent actuation of foam pump 114, and substantially all of the liquid and air mixture has been expelled through outlet passage 140.

In light of the foregoing, it should be clear that this invention provides improvements in the art of foam pumps. While a particular embodiment has been disclosed herein for the purpose of teaching the inventive concepts, it is to be appreciated that the invention is not limited to or by any particular structure shown and described. Rather, the claims shall serve to define the invention.

What is claimed is:

1. A two-stroke foam pump comprising:

(a) a piston housing including a base wall and at least one sidewall extending from said base wall;

(b) a piston assembly including:

(i) a piston having a base end, said piston being selectively movable in said piston housing from a rest position wherein said base end lies proximate said base wall of said housing to a charged position wherein said base end lies farther away from said base wall of said housing, with movement of said base end away from said base wall serving to define a compressible mixing chamber that expands in volume as said base end is moved away from said base wall, and decreases in volume as said base end is moved toward said base wall, (ii) an outlet passage extending through said piston from said base end to an outlet, said outlet passage fluidly communicating with said compressible mixing chamber, (c) a liquid inlet in said housing communicating with said compressible mixing chamber;

(d) a liquid inlet valve regulating fluid flow into said compressible mixing chamber through said liquid inlet, (e) an air inlet separate from the liquid inlet communicating with said compressible mixing chamber;

wherein movement of said base end away from said base wall increases the volume of said compressible mixing chamber thus drawing air into said compressible mixing chamber through said air inlet and drawing liquid into said compressible liquid chamber through said liquid inlet, thereby creating a premix of liquid and air in said compressible mixing chamber, and wherein, thereafter, movement of said base end toward said base wall forces at least a portion of said premix of liquid and air through said outlet passage of said piston.

2. The two-stroke piston of claim 1, wherein said piston assembly further includes:

(iv) an outlet valve regulating fluid flow through said outlet passage, permitting fluid flow from within said compressible mixing chamber, through said outlet valve, and toward said outlet and prohibiting fluid flow through said outlet valve and into said compressible mixing chamber, with movement of said base end toward said base wall forcing at least a portion of said premix of liquid and air through said outlet valve.

3. The two-stroke piston pump of claim 2, further comprising:

an air inlet valve regulating fluid flow into said compressible mixing chamber through said air inlet, said air inlet being defined through said housing.

4. The two-stroke foam pump of claim 3, further comprising a seal proximate said base end extending from said piston to contact said at least one sidewall of said piston housing, said seal also serving to define said compressible mixing chamber.

5. The two-stroke foam pump of claim 1, further comprising a cover plate on said piston housing, said piston extending through said cover plate to present said outlet exteriorly of said piston housing.

6. The two-stroke foam pump of claim 3, further comprising a mesh screen communicating with said outlet passage of said piston, with movement of said base end toward said base wall forcing at least a portion of said premix of liquid and air through said mesh screen.

7. The two stroke foam pump of claim 1 further comprising a container secured to the pump housing.

8. The two stroke foam pump of claim 7 further comprising a foamable liquid.

9. A two-stroke foam pump comprising:

(a) a piston housing including a base wall and at least one sidewall extending from said base wall;

(b) a piston assembly including:

(i) a piston having a base end, said piston being selectively movable in said piston housing from a rest position wherein said base end lies proximate said base wall of said housing to a charged position wherein said base end lies farther away from said base wall of said housing, with movement of said base end away from said base wall serving to define a compressible mixing chamber that expands in volume as said base end is moved away from said base wall, and decreases in volume as said base end is moved toward said base wall, (ii) an outlet passage extending through said piston from said base end to an outlet, said outlet passage fluidly communicating with said compressible mixing chamber, (c) a liquid inlet in said housing communicating with said compressible mixing chamber;

(d) a liquid inlet valve regulating fluid flow into said compressible mixing chamber through said liquid inlet, (e) an air inlet communicating with said compressible mixing chamber;

wherein movement of said base end away from said base wall increases the volume of said compressible mixing chamber thus drawing air into said compressible mixing chamber through said air inlet and drawing liquid into said compressible liquid chamber through said liquid inlet, thereby creating a premix of liquid and air in said compressible mixing chamber, and wherein, thereafter, movement of said base end toward said base wall forces at least a portion of said premix of liquid and air through said outlet passage of said piston, wherein said piston housing includes a post extending from said piston housing, and said piston includes a bore including:

a first section surrounding and engaging said post through a seal, a second section extending from said first section to said base end of said piston and having a diameter greater than that of said first section so as to surround said post and define an annular space between said post and said second section;

a third section extending from said first section toward said outlet, wherein said piston moves relative to said post, and movement of said base end of said piston away from said base wall of said piston housing disengages the sealing between said first section and said post when said second section reaches said seal.

10. The two-stroke foam pump of claim 9, wherein movement of said base end away from said base wall increases the volume of said compressible mixing chamber and draws liquid into said compressible liquid chamber until said second section of said bore reaches said seal, at which position an air path is created between said outlet and said compressible mixing chamber, thereby allowing air to flow in through said outlet and through said third section to create said premix of liquid and air.

11. A two stroke foam pump comprising:

a piston housing;

a post extending from said piston housing;

a piston;

a sealing member for providing a seal between the piston and the piston housing;

the piston comprising a bore;

the bore having:

a first section having a diameter configured to surround and engage said post through the sealing member, a second section extending from said first section to said base end of said piston and having a diameter greater than that of said first section so as to surround said post and define an annular space between said post and said second section;

a third section extending from said first section toward said outlet, wherein said piston moves relative to said post, and movement of said base end of said piston away from said base wall of said piston housing disengages the sealing between said first section and said post when said second section of the bore is proximate said sealing member.

12. The two stroke foam pump of claim 11 further comprising a liquid inlet into the piston housing and a liquid inlet valve located proximate the liquid inlet.

13. The two stroke foam pump of claim 11 comprising a liquid inlet into the piston housing and an air inlet into the piston housing wherein the liquid inlet is separate from the air inlet.

14. The two stroke foam pump of claim 11 wherein the piston and piston housing at least partially form a mixing chamber and the two stroke foam pump includes an outlet valve located proximate an outlet of the mixing chamber.

15. The two stroke foam pump of claim 11 further comprising a container secured to the pump housing.

16. The two stroke foam pump of claim 15 further comprising a foamable liquid.

17. A two-stroke foam pump comprising:

(a) a piston housing including a base wall and at least one sidewall extending from said base wall;

(b) a piston assembly including:

(i) a piston having a base end, said piston being selectively movable in said piston housing from a rest position wherein said base end lies proximate said base wall of said housing to a charged position wherein said base end lies farther away from said base wall of said housing, with movement of said base end away from said base wall serving to define a compressible mixing chamber that expands in volume as said base end is moved away from said base wall, and decreases in volume as said base end is moved toward said base wall, (ii) an outlet passage in fluid communication with the compressible mixing chamber, (c) a liquid inlet in said housing communicating with said compressible mixing chamber;

(d) a liquid inlet valve regulating fluid flow into said compressible mixing chamber through said liquid inlet, (e) an air inlet separate from the liquid inlet communicating with said compressible mixing chamber, wherein movement of said base end away from said base wall increases the volume of said compressible mixing chamber thus drawing air into said compressible mixing chamber through said air inlet and drawing liquid into said compressible liquid chamber through said liquid inlet, thereby creating a premix of liquid and air in said compressible mixing chamber, and wherein, thereafter, movement of said base end toward said base wall forces at least a portion of said premix of liquid and air through said outlet passage of said piston.

18. The two stroke foam pump of claim 17 further comprising a container secured to the pump housing.

19. The two stroke foam pump of claim 18 further comprising a foamable liquid.

20. The two stroke foam pump of claim 17 wherein the liquid outlet is located in the piston.

* * * * *